US007180399B2

(12) United States Patent
Chung

(10) Patent No.: US 7,180,399 B2
(45) Date of Patent: Feb. 20, 2007

(54) TRANSFORMER FOR RESONANT INVERTER

(76) Inventor: Yu-Lin Chung, No. 4, Lane 130, Nan-Kang Rd, Sec. 3, Taipei (TW)

( * ) Notice: Subject to any disclaimer, the term of this patent is extended or adjusted under 35 U.S.C. 154(b) by 33 days.

(21) Appl. No.: 11/030,842

(22) Filed: Jan. 6, 2005

(65) Prior Publication Data

US 2006/0145802 A1 Jul. 6, 2006

(51) Int. Cl.
*H01F 27/30* (2006.01)
*H01F 27/24* (2006.01)

(52) U.S. Cl. ..... 336/212; 336/208

(58) Field of Classification Search ..... 336/208, 336/192, 198, 212
See application file for complete search history.

(56) References Cited

U.S. PATENT DOCUMENTS 4,401,539 A * 8/1983 Abe et al. ..... 204/192.13
5,760,670 A * 6/1998 Yeh et al. ..... 336/134
5,812,045 A * 9/1998 Ishikawa et al. ..... 336/83
6,404,320 B1 * 6/2002 Yeh et al. ..... 336/200
6,424,247 B2 * 7/2002 Suzuki ..... 336/110
6,483,411 B2 * 11/2002 Chiang et al. ..... 336/182
6,650,218 B1 * 11/2003 Fushimi ..... 336/178
6,867,676 B1 * 3/2005 Chung ..... 336/198
6,967,558 B2 * 11/2005 Fushimi ..... 336/208

* cited by examiner

*Primary Examiner*—Anh T. Mai
(74) *Attorney, Agent, or Firm*—Pro-Techtor Int'l Services

(57) ABSTRACT

A transformer for resonant inverter, which utilizes magnetic substances infilled between a primary coil and a secondary coil to compel part of the magnetic lines of force of the primary coil not to cross-link with the secondary coil, which thereby achieves regulating leakage inductance. Furthermore, need to renew an existing iron core and bobbin is eliminated, and surmounts the difficult problem of controlling leakage inductance in original configurational designs, thereby decreasing man-hours, enhancing efficiency, and saving on costs.

2 Claims, 2 Drawing Sheets

TRANSFORMER FOR RESONANT INVERTER

BACKGROUND OF THE INVENTION (a) Field of the Invention

The present invention relates to a transformer for use in a backlit resonance circuit, and which utilizes magnetic substances infilled between a primary coil and a secondary coil that compel part of the magnetic lines of force of the primary coil not to cross-link with the secondary coil, thereby achieving objective of regulating leakage inductance.

(b) Description of the Prior Art

A traditional backlit resonance circuit using a transformer leakage inductance utilizes following means:

1. Regulating distance D between a primary coil P and a secondary coil S (see FIG. 1) to regulate a cross-linking coefficient, which further regulates the leakage inductance value.

2. If requirement of the leakage inductance value is relatively high, then number of coils are necessarily increased in order to achieve objective, which is a wastage of costs and is unsafe to use, and results in an increase in related manufacturing costs.

Shortcomings of a traditional backlit module output transformer:

1. Standardization of structure is impossible according to the aforementioned factors, making production difficult.

2. Because of the aforementioned factors, distance between the primary coil and the secondary coil is increased, coil window of the secondary coil is reduced, and number of coils is increased, which forces reduction in wire dimensions.

3. Reduction in coil window of the secondary coil results in deterioration in interbedded insulation and easy burnout.

4. Reduction in wire dimensions results in an increase in temperature of the transformer, and wire dimensions of the secondary coil is often less than that of hair, causing difficulty in manipulating the wire, and the wire easily breaks.

In the wake of incessant changes in display unit technology, because of smallness and relative thinness, a LCD monitor occupies relatively less space; moreover, picture quality is stable and does not flicker. Hence, the LCD monitor is gradually replacing the traditional cathode ray tube (CRT) monitor. A backlit module is configured in the liquid crystal display monitor, and contains a high voltage driven cold cathode tube, which functions as a backlit light source to implement display. In general, such a light tube is actuated by an inverter, and, apart from a drive circuit being provided interior of the light tube, a primary structure of the light tube encompasses a high voltage transformer, moreover, besides size of current inverters becoming smaller and smaller, the inverters are also becoming more and more efficient, with key factor lying in the output transformer requiring a relatively high and accurate leakage inductance value.

SUMMARY OF THE INVENTION

A primary objective of the present invention is to provide a backlit module output transformer using a magnetic substances insert between a primary coil and a secondary coil to compel part of the magnetic lines of force of the primary coil not to cross-link with the secondary coil, thereby achieving an objective of regulating the leakage inductance. The present invention improves upon shortcomings of the conventional backlit module output transformer, and thereby achieves substantial advancement of prior art.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
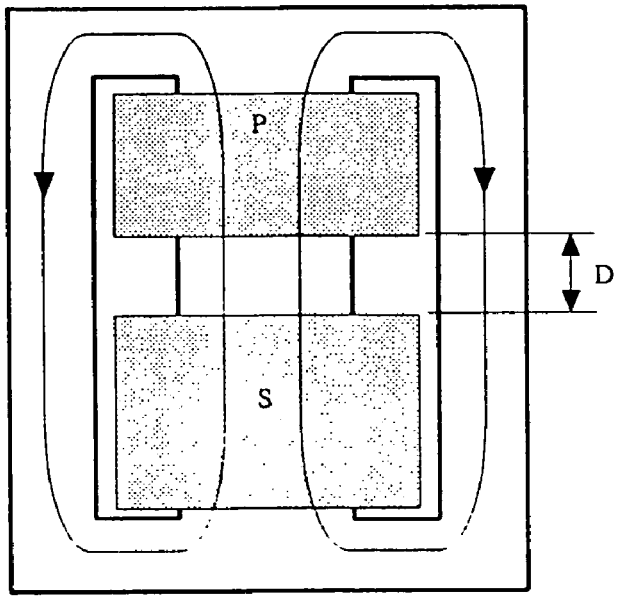
FIG.1 (PRIOR ART)
FIG. 1 shows a schematic view of magnetic lines of force of a primary coil and a secondary coil of a transformer as used in a conventional inverter.
Figure 2:
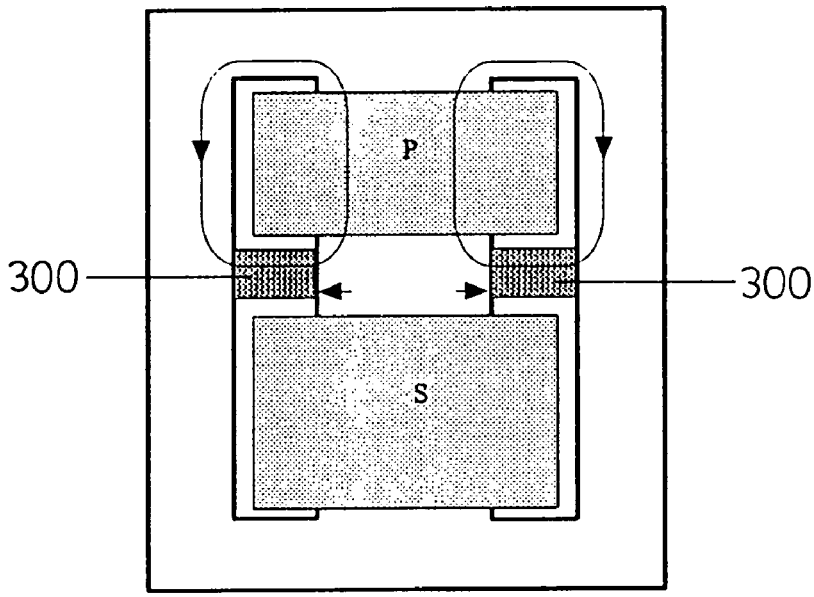
FIG. 2 shows a schematic view of magnetic lines of force of a transformer as used in an inverter according to the present invention.
Figure 3:
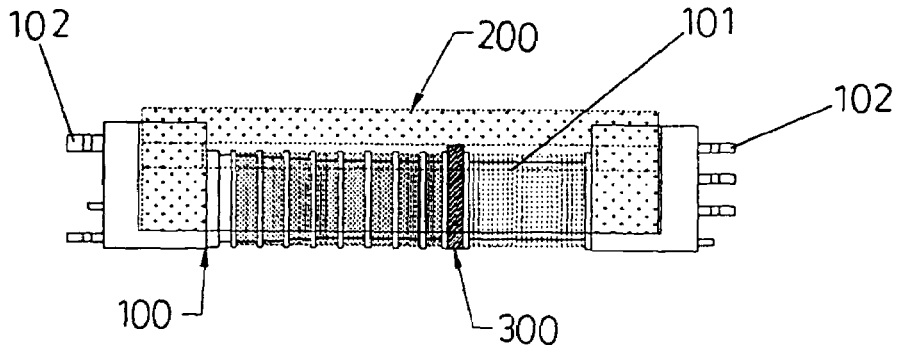
FIG. 3 shows an embodiment according to the present invention.
Figure 4:
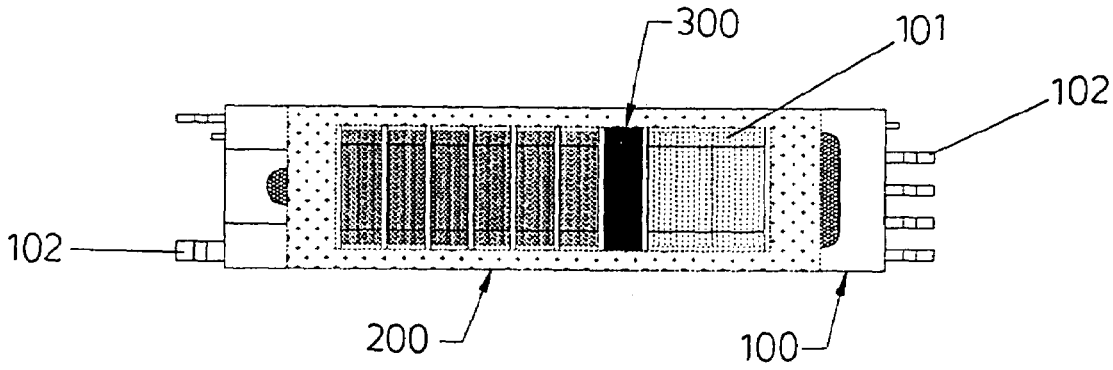
FIG. 4 shows another embodiment according to the present invention.

Referring to FIGS. 2, 3 and 4, which show a miniature transformer of the present invention comprising structural members including a wiring frame 100, an iron core 200 and a magnetic substances insert 300. A bobbin 101 at one end of the wiring frame 100 provides for copper wire to be wound thereon, and terminals 102 are respectively configured on a left end and a right end of the wiring frame 100. The present invention is characterized in that:

A backlit resonance circuit uses a magnetic substances insert 300 between a primary coil P and a secondary coil S (see FIG. 2) to compel part of the magnetic lines of force of the primary coil P not to cross-link with the secondary coil S, which thereby achieves objective of regulating leakage inductance (see FIG. 2 for leakage paths of the magnetic lines of force). The present invention improves upon shortcomings of a conventional backlit module output transformer, and thereby achieves substantial advancement of prior art.

The present invention can also be configured so as to utilize only one of the magnetic substances insert 300; moreover, the magnetic substances insert 300 can be of different material according to requirements. In addition, further magnetic substances inserts 300 can be added, thus eliminating need to renew the existing iron core 200 and the bobbin 101, moreover, the iron core 200 can be renewed, thus decreasing man-hours.

In conclusion, the present invention uses the magnetic substances insert 300 between the primary coil P and the secondary coil S to compel part of the magnetic lines of force of the primary coil P not to cross-link with the secondary coil S, which thereby achieves objective of regulating leakage inductance.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A transformer for a resonant inverter comprising:

a wiring frame having a primary coil, a secondary coil, and at least one magnetic substances insert located between said primary coil and said secondary coil;

an iron core; and terminals, respectively configured on a left end and a right end of the wiring frame;

wherein said at least one magnetic substances insert compels a portion of the magnetic lines of force of the primary coil to not cross-link with the secondary coil, thereby regulating the leakage inductance.

2. The transformer for a resonant inverter of claim 1, further comprising a bobbin at one end of said wiring frame, providing for copper wire to be wound thereon.

* * * * *